United States Patent [19]

Corse

[11] 4,211,167

[45] Jul. 8, 1980

[54] INKING DEVICE FOR PRINTING WITH GREASY INK

[75] Inventor: Louis G. Corse, Chaumont-sur-Tharonne, France

[73] Assignee: Machines Chambon, Orleans, France

[21] Appl. No.: 923,898

[22] Filed: Jul. 12, 1978

[30] Foreign Application Priority Data

Jul. 22, 1977 [FR] France ..... 77 22525

[51] Int. Cl.[2] ..... B41F 7/26; B41F 7/36; B41F 31/06

[52] U.S. Cl. ..... 101/148; 101/350; 101/363; 101/365; 118/262

[58] Field of Search ..... 101/148, 147, 349, 350, 101/351, 363, 364, 365, 207, 208, 206, 210; 118/259, 261, 262, 410, 414

[56] References Cited

U.S. PATENT DOCUMENTS

| | | | |
|---|---|---|---|
| 2,560,572 | 7/1951 | Haywood et al. | 118/262 X |
| 3,587,463 | 6/1971 | Granger | 101/366 |
| 3,640,203 | 2/1972 | Raab | 118/262 X |
| 3,926,114 | 12/1975 | Matuschke | 101/350 |
| 3,952,700 | 4/1976 | Little, Jr. | 118/259 |
| 4,041,864 | 8/1977 | Dahlgren et al. | 101/350 |

FOREIGN PATENT DOCUMENTS

| | | | |
|---|---|---|---|
| 2438668 | 3/1975 | Fed. Rep. of Germany | 101/363 |

*Primary Examiner*—J. Reed Fisher
*Attorney, Agent, or Firm*—J. Harold Nissen

[57] ABSTRACT

The present invention relates to an inking device for printing with greasy ink, said device being characterized in that it comprises, downstream of the zone of contact of the inking roller and the plate or photogravure cylinder, a second rod parallel to the inking roller, pressed under strong pressure against the soft surface layer of said roller and forming a barrier only against the dampening liquid, while allowing all the residual film of ink remaining on the periphery of the inking roller to pass and thus return to the mass of ink in the inking device. This invention is more particularly applicable in printing machines employing greasy ink, such as offset or typo printers.

10 Claims, 5 Drawing Figures

INKING DEVICE FOR PRINTING WITH GREASY INK

BACKGROUND OF THE INVENTION

The present invention relates to an inking device for printing with greasy ink, i.e. using an ink of a viscosity greater than 50 poises, which may be used in particular in greasy ink printing machines such as the offset or typo type.

So-called "short" inking devices are already known which comprise a soft rubber inking roller, in contact with a printing or plate cylinder and rotating at the tangential speed of said latter, and a doctor made of hard material, of very small diameter and connectable to a rod, which is applied under pressure against the inking roller and rotates in the same direction as said latter, i.e. the displacements of the two rollers are made in opposite direction in their zone of contact. A mass of ink is housed and contained in the space above the zone of contact of the two cylinders and the greasy ink is thus laminated on passage therebetween.

Theory and experience have shown that by applying the doctor under strong pressure against the inking roller, and by causing it to rotate in the direction of the inking roller, it was possible to laminate the ink and to obtain a film of ink of very small thickness, constant over the whole length of the inking roller, which conditions are necessary for obtaining a good quality print.

Furthermore, offset printing machines are usually provided with a dampening device which applies on the side surface of the previously inked inking roller, i.e. downstream of the ink trough, a film of a dampening liquid, conventionally water, which is conveyed jointly with the ink to the zone of contact between the inking roller and the plate cylinder.

It has been ascertained that with an inking device of the above-mentioned type, the dampening water may easily return to the ink trough if it is not taken along by the plate cylinder. This is particularly the case when particularly hydrophobic inks which absorb very little water are used for printing. In fact, the water which remains on the peripheral surface of the inking roller downstream of the zone of contact with the plate cylinder, and which is consequently returned by this inking roller into the ink trough, is normally combined with the ink to form a stable emulsion which is foreseen by the ink manufacturers and is therefore not a hindrance. On the contrary, if the capacity of emulsion is exceeded, the excess water remains in the form of drops disturbing the distribution of the ink in the ink trough: these heterogeneities of distribution are shown by streaks in the printing.

The return of water is less frequent in the conventional inking devices which comprise a plurality of rollers: the water here in fact meets a large surface and can evaporate under the effect of the heat and the ventilation provoked by the rotation of the rollers. However, these inking devices present such drawbacks that the "short" inking devices are preferred, despite the difficulty resulting from the dampening which has been set forth hereinabove.

SUMMARY OF THE INVENTION

It is an object of the present invention to remedy this drawback by means of an additional device of particularly simple design, preventing virtually all return of the damping water into the ink trough.

To this end, this inking device for a printing machine using greasy ink, comprising an inking roller with soft surface layer, particularly made of rubber, tangential to a printing or plate cylinder and rotating at the tangential speed of this latter, in opposite direction, and a doctor made of hard material parallel to the inking roller, of small diameter and connectable to a rod, applied under pressure against the inking roller and driven in rotation in the same direction as said latter, a mass of greasy ink being housed in a space upstream (considering the direction of rotation of the inking cylinder) of the zone of contact of the inking roller and plate or printing cylinder, said inking device being used in combination with a dampening device applying a film of liquid, such as water, on the previously inked surface of the inking roller, i.e. between the respective zones of contact of this roller with the rod forming the doctor on the one hand and the plate or printing cylinder on the other hand, is characterised in that it comprises, downstream of the zone of contact of the inking cylinder and the plate or printing cylinder, a second rod, parallel to the inking roller, applied under strong pressure against the soft surface layer of this roller and forming a barrier solely against the dampening liquid, whilst allowing all the residual ink film remaining on the periphery of the inking roller to pass and thus return to the mass of the ink of the inking device.

The inking device according to the invention offers the advantage that the residual water remaining on the surface of the inking roller, downstream of its zone of contact with the plate or printing cylinder, is intercepted and is recovered so that it can in no way be reintroduced into the mass of ink of the inking devices. Consequently, all the printing defects noticed beforehand are eliminated.

According to a further feature of the present invention, the first rod forming doctor and the second rod forming barrier against the dampening liquid are mounted on the same support block, the first rod being disposed upstream (considering the direction of rotation of the inking roller) with respect to the second rod, and means are provided to bring the ink into the space defined by the two rods, the peripheral surface of the inking roller and the support block. Means are preferably provided to bring the ink under pressure into the said space.

Due to this latter arrangement, the second rod forming barrier against the dampening liquid hermetically closes the ink trough thus constituted preventing the ink from leaving on this side.

Such a tight ink trough presents numerous advantages, namely:

1. it allows an automatic supply of the ink;
2. it allows dismantling without having to drain the ink;
3. it reduces the frequency of cleaning, because, due to the fact that the ink contained in the ink trough is in contact neither with the air nor with the light, it can neither oxidise nor polymerise (in the case of ink drying by means of ultraviolet rays);
4. it is possible to mount the ink trough in all directions about the inking roller, this reducing the constraints involved in designing a machine using such an inking device.

BRIEF DESCRIPTION OF THE DRAWINGS

The present invention will be more readily understood on reading the following description with reference to the accompanying drawings, in which.

DESCRIPTION OF THE PREFERRED EMBODIMENT

Figure 1:
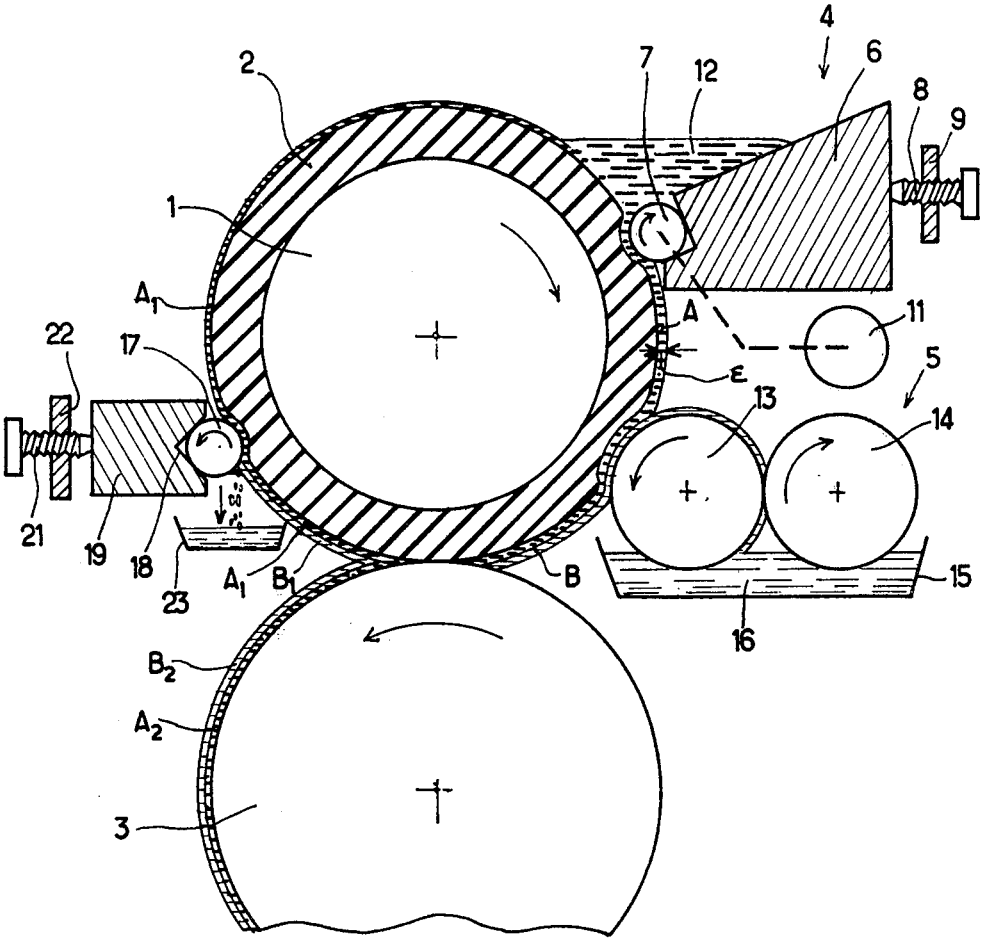
FIG. 1 is a schamtic view in vertical section of a rotary offset printing machine provided with an inking device according to the invention.

Referring now to the drawings, the offset printing machine shown schematically in FIG. 1 conventionally comprises an upper inking roller 1, comprising a soft surface layer 2, for example rubber, and a lower plate or printing cylinder 3 tangential to the preceding one. The two rollers 1 and 3 rotate in opposite direction, as indicated by the arrows in FIG. 1.

The rotary offset printing machine further comprises an inking device 4 and a dampening device 5.

The inking device 4 comprises a block 6 forming ink trough and also constituting a support for a doctor 7 made of hard material, parallel to the inking roller 1 and of small diameter with respect to that of this roller. The rod-shaped doctor 7, is applied under strong pressure against the inking roller 1 and, consequently, it is driven somewhat into the soft surface layer 2 of this roller, as shown in exaggerated manner in FIG. 1. The pressure may be exerted by any suitable means, for example by means of screws 8 abutting on the support block 6 and screwed in a fixed support 9, or by jacks, etc. The rod 7 forming the doctor is rotated by a variable speed electric motor 11 in the same direction as the inking roller 1. The block 6 constituting the support of the doctor 7 forms an ink trough with lateral faces, this ink trough containing, above the rod 7, a certain quality of greasy ink 12 (of viscosity higher than 50 poises). The doctor 7 therefore ensures a lamination of the greasy ink 12 so that, downstream of the zone of contact between the inking roller 1 and the doctor 7, there is formed a film of ink A of very small thickness $\epsilon$ (of the order of 12 microns in a practical application), this thickness being perfectly constant over the whole lenght of the inking roller 1.

The dampening device 5 comprises two cylinders 13 and 14 tangential with respect to each other, of axes parallel to the axes of the inking roller 1 and place cylinder 3 and rotated in opposite directions as indicated by the arrows. The lower parts of these two cylinders are immersed in a vat 15 containing a dampening liquid 16, for example water. The cylinder 13 which rotates in opposite direction from the inking roller 1, is tangential thereto and consequently deposits on the peripheral surface of the inking roller already bearing the film of ink A, an additional film of water B which is conveyed jointly with the film of ink A, towards the plate cylinder 3.

Downstream of the zone of contact of the inking roller 1 and of the plate cylinder 3, the films of ink and water each subdivide into two films, namely, for the film of ink A, into a residual film of ink $A_1$ on the peripheral surface of the inking roller 1 and a film of ink $A_2$ on the surface of the plate cylinder 3, and, for the film of water B, a residual film of water $B_1$ on the inking roller 1 and a film of water $B_2$ on the surface of the plate cylinder 3.

The films $A_2$ and $B_2$ are used for printing on the web (not shown) whilst the films $A_1$ and $B_1$ are returned by the inking roller 2 in the direction of the inking device 4.

To avod the return of the residual film of water $B_1$, present on the surface of the inking roller 2, in the mass of ink 12 of the inking device 4, a second rod 17 is provided, according to the invention, which is parallel to the inking roller and pressed under strong pressure against the soft surface layer 2 of this roller. To this end, the second rod 17 is held in a V-groove 18 of a support block 19 which is pressed in the direction of the inking roller 1 by any suitable means, for example by screws 21 in a support 22 or by jacks, etc.

The second rod 17 is pressed against the inking roller 1 in the lower left-hand part thereof, as shown in FIG. 1, i.e. it is substantially diametrically opposite the doctor blade 7 of the inking device which is in contact with the upper right-hand part of the inking roller 1. However, this arrangement is in no way limiting, as will be seen with regard to the description of the other embodiments of the invention.

Theory and practice have shown that the second rod 17 constitutes an effective barrier against the dampening water which it prevents from passing between itself and the inking roller 1, whilst allowing the passage of the film of ink $A_1$. This is due to the differential effect of lamination exerted by the rod 17 on the film of ink $A_1$ of high viscosity (higher than 50 poises), and on the film of water $B_1$, of low viscosity (of the order of 1 centipoise).

In fact, the thickness $\epsilon$ of the film of ink A formed on the inking roller 1 by the rod 7 is defined by the following formula:

$$\epsilon = \frac{1}{2}\left(1 - \frac{V_E}{V}\right)^2 \sqrt[4]{\frac{R}{S}} \cdot \sqrt{\frac{e\mu V}{2E}}$$

wherein

V is the tangential speed of the inking roller 1;

$V_E$ is the tangential speed of the doctor 7;

R is the radius of the doctor 7;

S is the penetration of the doctor 7 in the inking roller 1;

E is the modulus of elasticity of the elastomer with which the inking roller is provided;

e is the thickness of the elastomer with which the inking roller is provided and; p1 $\mu$ is the viscosity of the ink;

The second rod 17 may be considered as exerting an effect of lamination similar to that of the first rod 7. In the zone of lamination between the rod 17 and the inking roller 1 there are two films, namely the film of ink $A_1$ of thickness $\epsilon_1 = \epsilon:2$, and the film of water $B_1$ of thickness x.

The rod 17 is adjusted so that it laminates the film of water $B_1$ to a thickness $\epsilon_2 \geqq \epsilon_1$. Consequently, the rod 17 cannot reduce the thickness of the film of ink $A_1$ and the same therefore allows it to pass completely. On the contrary, the water constituting the film $B_1$ will be laminated on the inking roller 1 to a thickness $\epsilon_2$ which is a function of its viscosity and the other parameters figuring in the above formula.

The basic formula allows the following to be written:

$$\frac{\epsilon_1}{\epsilon_2} = \left( \frac{1 - \frac{V_{E1}}{V}}{1 - \frac{V_{E2}}{V}} \right)^2 \cdot \sqrt{\frac{\mu_1}{\mu_2}}$$

If it is assumed that the average adjustment of the wiping corresponds to $$\frac{V_{E1}}{V} = 0{,}5 \text{ (50\% wiping rate)}$$

that the second rod 17 is immobile therefore $V_{E2}=0$ and if $\mu_1$, viscosity of the ink, is of the order of 300 poises and $\mu_2$, viscosity of the water, is 1 centipoise the following is obtained:

$$\frac{\epsilon_1}{\epsilon_2} = (0{,}5)^2 \sqrt{\frac{300}{10^{-2}}} = 44$$

It is therefore seen that the film of the water laminated by the second rod 17 has, downstream of the latter, a thickness which is almost 50 times smaller than that of the residual film of ink $A_1$ remaining on the periphery of the inking roller. In practice, it has been ascertained that the quantity of water which could pass through the second rod 17 forming barrier was even less. This may be explained, as the formula used previously was established in the hypothesis of a laminar flow where the fluid moistens the walls which laminate. Now, the water cannot moisten the inking roller 1 which is coated with ink and it therefore does not receive for its part the shear effort necessary for provoking lamination. In practice, the second rod 17 allows all of the film of ink $A_1$ to pass, which may thus return into the mass of ink 12 contained in the ink trough 6, whilst on the contrary it retains all the film of water $B_1$ present on the inking roller 1.

The water which is thus intercepted by the second rod 17 may be recovered in a channel 23 located beneath the second rod 17 which returns it for example to the vat 16 containing the reserve of dampening liquid.

Other arrangements may be provided for recovering the water, but the one illustrated in FIG. 1 is the simplest as recovery is effected by gravity.

A particularly advantageous embodiment of the invention will now be described with reference to FIG. 2, which enables a tight ink trough to be made. In this Figure, in the same way as in FIGS. 3 to 5, the same constituent elements as those appearing in FIG. 1 are given the same reference numerals.

Figure 2:
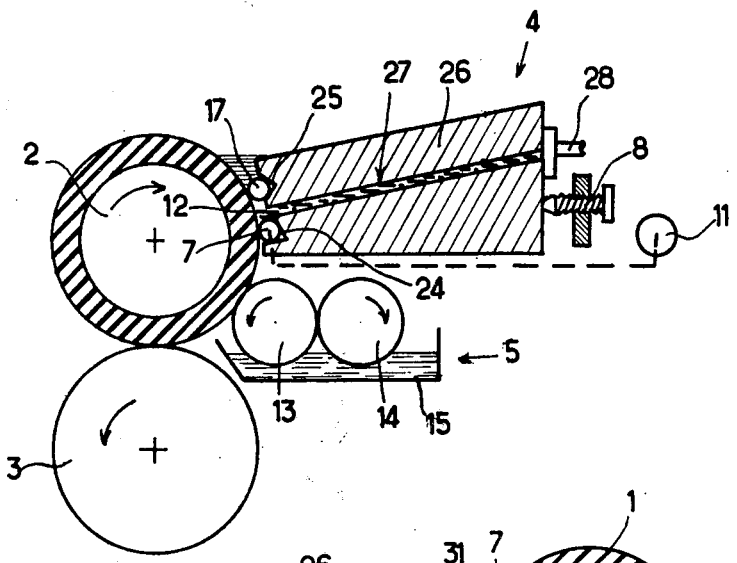
FIG. 2 is a schematic section through an offset printer using a tight ink trough.

In the embodiment illustrated in FIG. 2, the second rod 17 forming barrier against the dampening water is disposed on the same side of the inking roller 2 as the doctor rod 7 and a little above said latter. The two rods 7 and 17 are housed in respective V-grooves 24,25 made in the front face, close to the inking roller 1, of a common support block 26. This support block is applied under pressure against the inking roller 1, for example by means of screws 8.

It is therefore seen that the second rod 17, forming barrier against the dampening water, closes the upper part of the ink trough which is normally in contact with the open air. This enables a tight ink trough to be made in which the ink may be conveyed under pressure. The mass of ink 12 which is laminated by the doctor 7, rotated by the electric motor 11, is thus contained in a space defined by the two rods 7 and 17, the peripheral surface of the inking roller 2 and the support block 26. The ink may be brought under pressure into this space through a conduit 27 passing right through the block and connected at the outside to a pressurized ink inlet pipe 28. The supply pressure of the ink must of course be much lower than the pressure of lamination but, as this latter is very high, the supply has no influence on the lamination of the film of ink.

As may be seen in FIG. 2, with this device, the residual water present on the periphery of the inking roller 1, is returned by said latter to the upper part of the ink trough, above the second rod 17 forming barrier. The water which is thus stopped by this rod 17 may be evacuated by any suitable means for example by a suction device.

In the embodiment shown in FIG. 2, the two rods 7 and 17 are applied against the inking roller 1 in the zone of the descending movement of its generatrices, above the dampening device.

Figure 3:
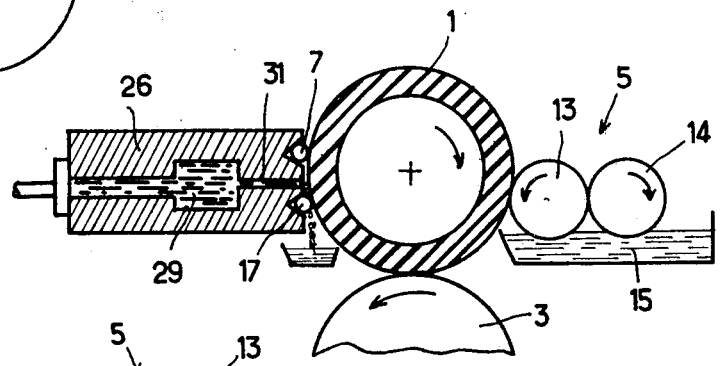
FIGS. 3,4 and 5 are schematic views in section of variant embodiments.

On the contrary, in the embodiment shown in FIG. 3, the two rods 7 and 17 are applied against the inking roller 2 in the zone of the ascending movement of its generatrices. Under these conditions, the second rod 17 forming barrier against the water is located beneath the doctor laminating the ink, this enabling the water to be recovered by gravity, as in the case of the device illustrated in FIG. 1. The block 26 constituting the tight ink trough is thus substantially diametrical opposite the dampening device 5. This block 26 internally comprises a distribution chamber 29 extending over the whole lenght of the block, parallel to the inking roller 1, and this distribution chamber communicates via a distribution slot 31 with the space where the mass of ink 12 is permanently kept, between the two rods 7 and 17. This slot 31 extends also over the whole lenght of the inking roller 1.

Figure 4:
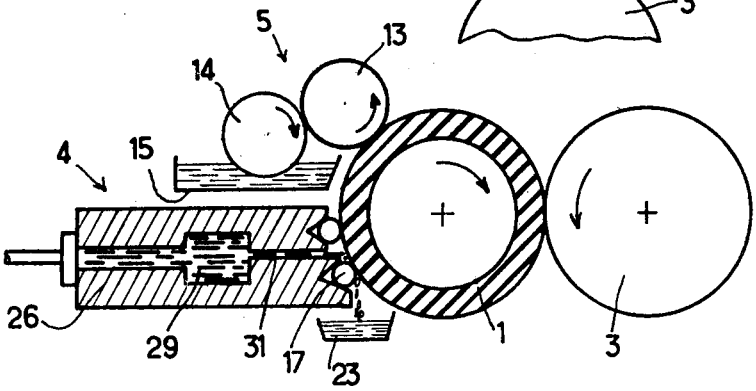

FIG. 4 illustrates a device similar to FIG. 3, but in this case the inking device 4 is disposed beneath the dampening device 5, these two devices being located on the same side of the inking roller 1.

Figure 5:
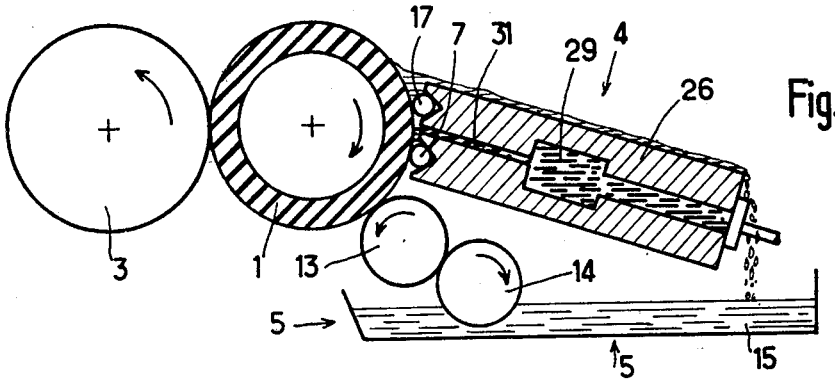

In the embodiment illustrated in FIG. 5, the inking device 4 is completely located above the dampening device 5 and the support block 26 is inclined with respect to the horizontal, so that the water intercepted by the second rod 17 forming barrier may trickle over the upper surface of the block and drop by gravity into the vat 15 comprising the dampening water.

In all embodiments of the invention, the second rod 17 intercepting the water may be rotated in the opposite rotational direction as the inking roller, but in the same peripheral direction as the inking roller at their coacting nip, to ensure the lamination of the film of water; however, it may also be stationary, this obviously constituting a more advantageous solution.

In the embodiments illustrated in FIGS. 2 to 5, in which the two rods 7 and 17 are carried by the same support block 26, the penetration of these two rods in the soft surface layer 2 of the inking roller 1, is the same. In these conditions, whatever the adjustment of penetration chosen in operation, it is certain that $\epsilon_2 \geqq \mu_1$ synthetically, if the doctor 7 rotates and the barrier rod 17 is stationary, which condition is indispensable for the good functioning of the inking device as has been seen previously. The water barrier rod 17 therefore does not have to be adjusted separately.

What I claim is:

1. An inking device for a printing machine using greasy ink, comprising an inking roller with a soft surface layer tangential to a printing cylinder and rotating at the tangential speed of the latter, in the opposite rotational direction, and a small-diameter rod-shaped doctor roller made of hard material extending parallel to the inking roller applied under pressure against the inking roller, a mass of greasy ink being housed in a space lateral upstream, with reference to the direction of rotation of the inking roller, of the zone of contact of the inking roller and printing cylinder, a dampening device engaging and applying a film of dampening liquid, such as water, to the previously inked surface of the inking roller downstream of the zone of contact of the inking roller with the doctor roller and upstream of the zone of contact of the inking roller and the printing cylinder, wherein said inking device comprises, downstream of the zone of contact of the inking roller and the printing cylinder, a second rod extending parallel to the inking roller, applied under strong pressure against the soft surface layer of the inking roller and forming a barrier solely against the dampening liquid while allowing all the residual film of ink remaining in the periphery of the inking roller to pass and return to the mass of ink in said space.

2. An inking device as defined in claim 1, wherein the rod forming the doctor roller and the second rod forming the barrier against the dampening liquid are mounted on the same support block and means are provided to guide the ink into the space defined by the two rods, the peripheral surface of the inking roller and the support block; the block having a conduit extending through it and connected on the one hand to a pressurized ink inlet pipe and on the other hand to the space in which the mass of ink is contained between the two rods, said conduit opening into a distribution chamber in the support block and communicating via a distribution slot with the space between the two rods; the support block of the two rods being applied against the inking roller in the descending quadrant of movement thereof above the dampening device, the second rod forming the barrier against the dampening liquid being located in the immediate vicinity of the doctor roller above said latter; the support block having an upper part of its front face supporting the second rod forming barrier, and an upper surface downwardly inclined starting from the second rod and forming a surface over which the recovered liquid trickles by gravity; and means to rotate the second rod in the opposite rotational direction as the inking roller.

3. An inking device as claimed in claim 1, wherein the rod forming the doctor roller and the second rod forming the barrier against the dampening liquid are mounted on the same support block and means are provided to guide the ink into the space defined by the two rods, the peripheral surface of the inking roller and the support block.

4. An inking device as claimed in claims 3, wherein the block has a conduit extending through it and connected on the one hand to a pressurized ink inlet pipe and on the other hand to the space in which the mass of ink is contained between the two rods.

5. An inking device as claimed in claim 4, wherein the conduit opens into a distribution chamber in the support block and communicates, via a distribution slot, with the space between the two rods.

6. An inking device as claimed in claim 3, wherein the support block of the two rods is applied against the inking roller in the descending quadrant of movement thereof above the dampening device, and the second rod forming the barrier against the dampening liquid is located in the intermediate vicinity of the doctor roller, above said latter.

7. An inking device as claimed in claim 6, wherein the support block has an upper part of its front face supporting the second rod forming barrier, and an upper surface which is downwardly inclined starting from the second rod and forming a surface over which the recovered liquid trickles by gravity.

8. An inking device as claimed in claim 3, wherein the support block is applied against the inking roller in the ascending quadrant of movement thereof, opposite the dampening device, and the second rod forming barrier is located near the doctor roller below said latter, a channel for recovering the dampening liquid being disposed beneath the second rod.

9. An inking device as claimed in claim 1, wherein the second rod forming the barrier is stationary.

10. An inking roller as claimed in claim 1, wherein means are provided to rotate the second rod in the opposite rotational direction as the inking roller.

* * * * *